United States Patent [19]

Reynaud

[11] Patent Number: 4,936,603

[45] Date of Patent: Jun. 26, 1990

[54] ACCESSORY FOR LINKING SKI TIPS TOGETHER

[76] Inventor: Serge Reynaud, 34, rue des Pâquis, 1201 Geneva, Switzerland

[21] Appl. No.: 326,506

[22] Filed: Mar. 20, 1989

Related U.S. Application Data

[63] Continuation-in-part of Ser. No. 130,195, Dec. 8, 1987, abandoned.

[30] Foreign Application Priority Data

Jan. 9, 1987 [CH] Switzerland ..... 050/87

[51] Int. Cl.[5] ..... A63C 11/00

[52] U.S. Cl. ..... 280/818; 280/817

[58] Field of Search ..... 280/814, 815, 816, 817, 280/818; 224/323, 917; 441/73

[56] References Cited

U.S. PATENT DOCUMENTS

| | | | |
|---|---|---|---|
| 3,066,328 | 12/1962 | Jones | 280/818 |
| 3,357,714 | 12/1967 | Kuehn | 280/818 |
| 3,703,299 | 11/1972 | Kutchma | 280/818 |
| 3,862,764 | 1/1975 | Hartz | 280/818 |
| 3,907,320 | 9/1975 | Chameck | 280/818 |
| 3,992,022 | 11/1976 | Albers | 280/818 |
| 4,770,441 | 9/1988 | Demonsant et al. | 280/818 |

FOREIGN PATENT DOCUMENTS

| | | | |
|---|---|---|---|
| 745260 | 12/1943 | Fed. Rep. of Germany | 280/818 |
| 1945977 | 3/1971 | Fed. Rep. of Germany | 280/818 |
| 2247154 | 4/1973 | Fed. Rep. of Germany | 280/818 |
| 2911432 | 10/1980 | Fed. Rep. of Germany | 280/818 |
| 2553670 | 4/1985 | France | 280/818 |
| 64989 | 6/1942 | Norway | 280/815 |

*Primary Examiner*—David M. Mitchell
*Assistant Examiner*—Brian Johnson
*Attorney, Agent, or Firm*—Young & Thompson

[57] ABSTRACT

The accessory for skis, intended to link two skis together in order to facilitate their guidance, comprises a connecting leaf or strip (1) mounted on resiliently flexible members (3) rigidly fixed to the tips of the skis and making it possible to vary the relative position of said skis.

8 Claims, 3 Drawing Sheets

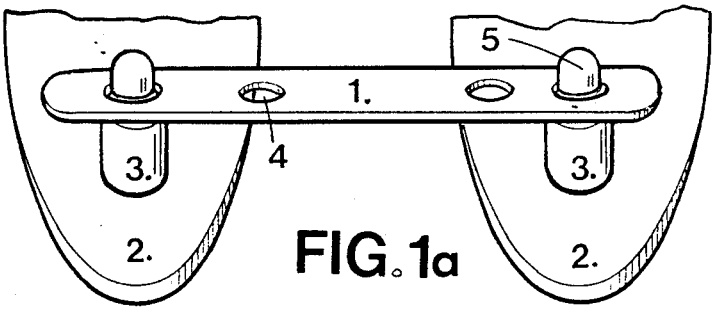
FIG. 1a
FIG. 1b
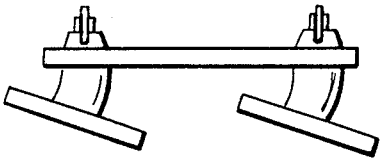
FIG. 1c
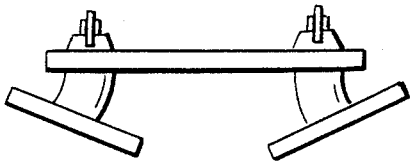
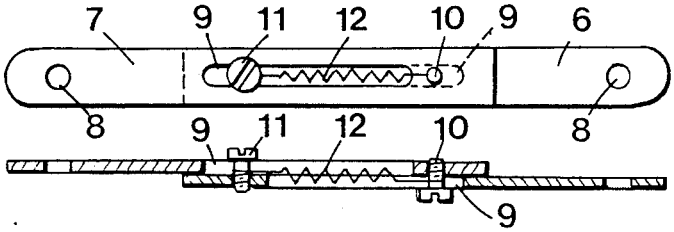
FIG. 2a
FIG. 2b
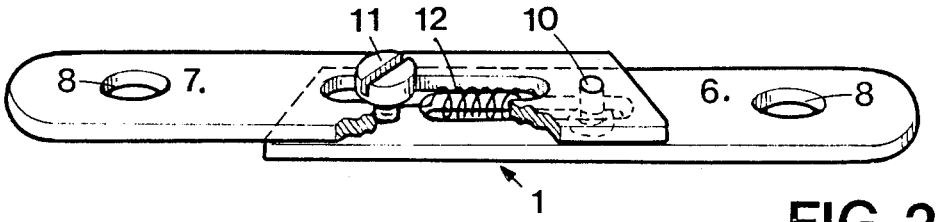
FIG. 2c FIG. 3a
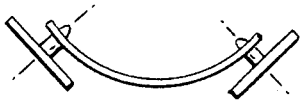
FIG. 3b
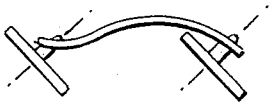
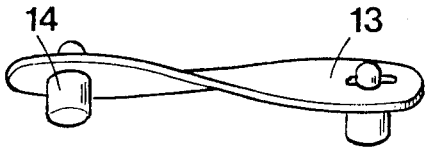
FIG. 3c
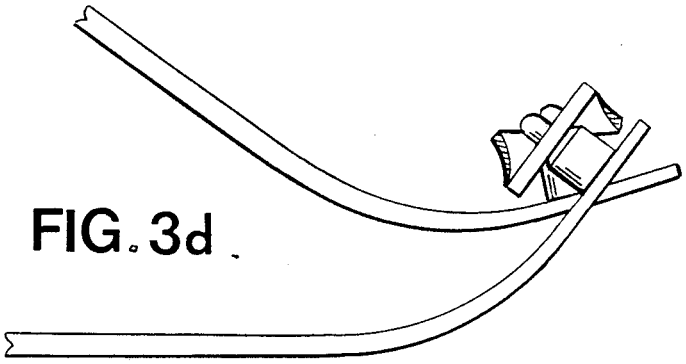
FIG. 3d
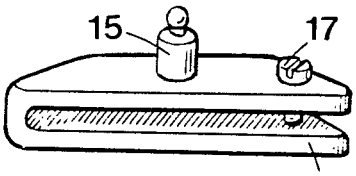
FIG. 4a
FIG. 4b
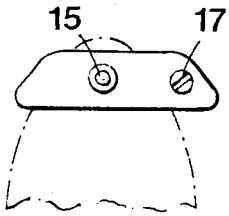

FIG. 5b
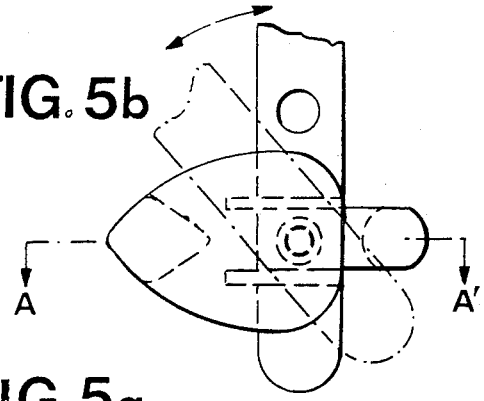
FIG. 5c
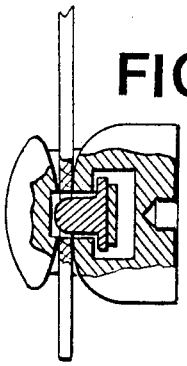
FIG. 5a
(A-A')
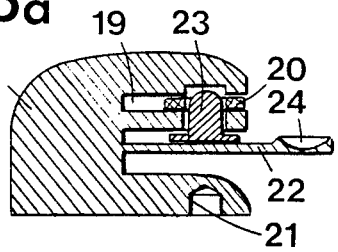
FIG. 6a
(B-B')
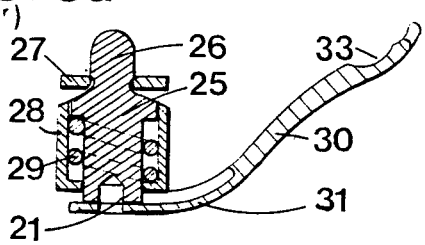
FIG. 6b
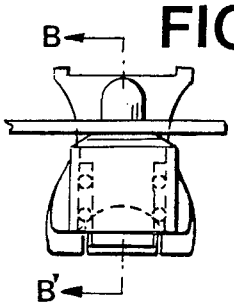
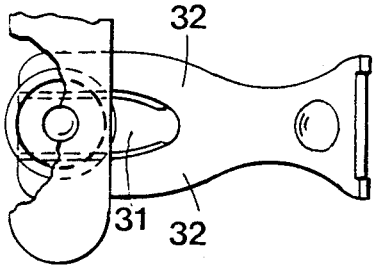
FIG. 6c
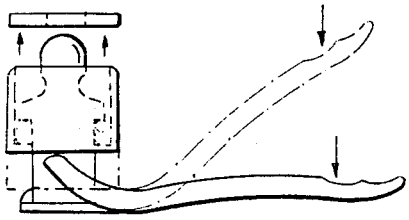
FIG. 6d

ACCESSORY FOR LINKING SKI TIPS TOGETHER

This application is a continuation-in-part of application Ser. No. 07/130,195, filed 12/8/87 now abandoned.

The present invention relates to an accessory for skis intended to link together the tips of a pair of skis in order to help guide said skis, comprising a connecting member articulated on two fastening members providing for attachment of said connecting member to the tips of the skis.

Accessories of this type are already known, which are essentially designed to prevent the crossing of the skis and to help a skier hold his skis in the snowplow position.

The accessory according to the present invention fulfills these two functions and, in addition, makes it possible to improve the guiding of the skis in all skiing positions, such that the accessory may be equally useful to skiers who want to improve their ski control during parallel turns. The accessory makes it possible for the skis to move in a roughly independent way, so as to enable their displacement, relative to one another, in oblique or longitudinal directions. To this end, the accessory which is the object of the present invention is characterized in that at least one of the three said members of the accessory comprises at least one resiliently flexible portion adapted to enable the skis to move freely, while maintaining the distance between their tips.

The attached drawings show by way of example and diagrammatically two embodiments and some modifications of the accessory which is the object of the invention.

FIG. 1*a* shows a first embodiment of the accessory comprising resiliently flexible fastening members, and FIGS. 1*b* and 1*c* show a variation thereof in which the top portion of the attachment stud is depicted somewhat differently.

FIGS. 2*a*, 2*b* and 2*c* show the connecting member in a modification of the embodiment of the accessory represented in FIG. 1.

FIGS. 3*a*, 3*b*, 3*c* and 3*d* show a second embodiment of the accessory comprising a resiliently flexible connecting member.

FIGS. 4*a* and 4*b* show a modification of one fastening member of the accessory according to the invention.

FIGS. 5*a*, *b*, *c* and 6*a*–*d* show other modifications.

The accessory for skis shown in FIG. 1 has a rigid bar 1 attached to the tips 2 of a pair of skis by way of two members 3 formed of a resiliently flexible material, as for example rubber, said members 3 being rigidly fixed to the skis by means of a screw or other. By "resiliently flexible" one means here any material that, once deformed, will revert to its initial shape and which has a certain mechanical strength.

The bar 1 is provided with four openings 4 adapted to engage with the head 5 of one of the members 3, so as to allow adjustment of the distance separating the connected skis. The resiliency of the members 3 makes it possible for the skis to be tilted relative to one another, as shown in FIG. 1*b*, which represents the skis in the position of parallel edging, while FIG. 1*c* shows the snowplow position in which the tips of the skis remain close together, the rear ends of the skis being spread apart.

It is clear that the bar 1 may be provided with any number of holes, in particular two. Furthermore, variation of the distance separating the tips of the skis may equally be achieved by means of a flexible or rigid bar such as shown in FIGS. 2*a*, 2*b* and 2*c*. According to this modification, the bar 1 comprises two parts 6 and 7, each part having an opening 8 adapted to receive the head of a member, not shown, which is rigidly fixed to the tip of a ski. Parts 6 and 7 are further provided with a longitudinal slot 9 through which screws 10,11 pass. The screw 10 engages a bore provided to this end in part 7 of bar 1, while screw 10 is screwed tight to the part 6 of said bar. The two parts 6 and 7 are superimposed and urged against each other by a spring 12 which links the two screws 10 and 11 together. When the skier's feet apply by their lateral movement force against this spring 12, the two skis are slightly spread out as a result of the sliding of parts 6 and 7 relative to one another, these parts returning to their initial position once the lateral force resulting from movement of the skier's feet ceases.

It should be noted that the sliding friction between parts 6 and 7 provides for a damping effect of the sliding motion and that this friction may be varied by varying the tightening of screws 10 and 11. A small plate of different material could also be inserted between the parts 6 and 7 to allow the adjustments of the friction coefficient relative to the desired clamping effect.

FIGS. 3*a* to 3*d* show a second embodiment of the accessory according to the invention, in which the connecting member is a resiliently flexible leaf or strip, mounted via oblong or elongated holes on the fastening members 14, each of which is fixed to the tip of a ski. As a result of the different degrees of torsion to which the leaf 13 may be subjected (FIG. 3*c*), the relative orientation of the skis may be varied, enabling the said skis to be guided in oblique (FIG. 3*a*) or parallel (FIG. 3*b*) positions. The elasticity of the leaf 13 provides for some spreading out of the skis and other solutions of the type already mentioned in relation to FIGS. 2*a* to 2*c* may be envisaged to enable a larger variation of the distance separating the two skis.

In the modification of a fastening member shown in FIGS. 4*a* and 4*b*, the member 15 comprises an extension of clamp 16 provided with a tightening screw 17. The clamp is then fastened to the tip of the ski by tightening the screw 17 (FIG. 4*b*). In this way, the accessory may then be easily removed from the skis and the skis do not have to be pierced by attachment means.

FIGS. 5 to 5*c* show a modification of a fastening member which is formed of a block 18, comprised for example of synthetic resin, said block being provided with a slot 19, intended to receive an end of an elastic leaf 20. The block has a threaded bore 21 which enables the attachment of the block 18 to a tip of a ski by means of an appropriate screw, in such a way that the plane of the slot 19 is substantially parallel to the surface of the ski tip. The block is also provided with a leaf 22 which is sufficiently thin to act as a leaf spring urging a pin 23 which can be moved longitudinally to extend into the slot 19, perpendicularly to the plane of the latter. Under the action of leaf 22, the pin 23 is able to penetrate into a hole provided in elastic leaf 20 to hingedly retain said leaf 20 on block 18. The leaf 22 is provided with a groove 24 making it possible for the skier to use the end of his ski stick against leaf 22 so as to release the pin 23 from the hole in elastic leaf 20 and remove said elastic leaf 20, to disconnect the tips from each other, if so desired.

FIGS. 6*a* to 6*d* show another embodiment where the fastening member comprises a stud 25 having a head 26 formed above a neck of lesser diameter on which head 26 one is able to engage by force a flexible leaf or strip 27, owing to its elasticity. In reference to FIG. 6*a*, it can be seen that any torsion of the flexible leaf 27 with respect to the stud 25 originates a self-tightening or shearing effect on the head 26 of stud 25, which results in improved attachment of the leaf to the stud. This stud 25 is further provided with a threaded bore 21 designed to enable the fastening of the stud to the ski. The stud is surrounded by a sleeve 28, urged toward the ski by a spring 29, arranged inside the sleeve 28 and around the stud 25. A fork shaped lever 30 is fixed underneath the stud by an elastic member 31, while the two branches 32 of the fork are located under the sleeve 28. With this arrangement, when pressure is applied on the end 33 of the lever 30, the branches 32 of the fork raise the sleeve 28 which, in turn, pushes the elastic leaf 27 upwards, thus releasing it from the head 26 of the stud 25, as shown in FIG. 6*d*.

As a result of the fact that the connecting member has a hinging point on each of the fastening members, it is possible to move either ski forward with respect to the other, which enables walking with the skis, amongst others, although the length of the steps is of course limited by the connecting member. Furthermore, the flexibility of the accessory, whether due to the presence of the rubber plugs, as in FIG. 1, and/or to the flexibility of the connecting leaf or strip, makes it possible to ride on both the inside edges, for executing turns in the snowplow position, as well as to ride on one inside edge and one outside edge to execute parallel turns. This elasticity and/or the articulations also enable the skier to lift one ski with respect to the other, the ski tips remaining of course linked together.

It is clear that the invention is not restricted to the embodiments shown. In particular, the shape of the fastening members may be any and different from the shape shown in the figures and the member connecting the skis may be held onto the fastening members by means of a mechanical hindrance such as a screw nut or a peg, or still by pinching of the connecting member in the way of a pressure button.

According to a modification, the connecting member could be provided with a ball-and-socket joint or similar at one of its ends and a housing at the other end, the fastening members on the skis being correspondingly shaped of course.

In addition, whenever the connecting member is flexible, the fastening members may be rigid.

The accessory for skis enables better guidance of the skis, while ensuring that they are relatively independent from one another. For training towards better control of the skis during parallel guiding, an additional ski accessory of the same type may be provided at the rear end of the skis.

It is quite clear that the accessory for skis described heretofore is useful not only for snow skiing but equally for water-skiing practice.

I claim:

1. An accessory for skis adapted to link the tips of said skis together to facilitate the guidance of same, comprising:

two fastening members attached to the respective tip ends of a pair of skis; and a connecting member having opposing ends, said ends being attached to said respective fastening members on said respective tip ends of said pair of skis, said connecting member being planar in configuration and resiliently deformable by either twisting or bending and permitting the orientation of one of said skis to be changed relative to the orientation of the other of said skis as a result of said twisting or bending while maintaining said tips spaced from each other, said connecting member including a hole in at least one end adapted for engagement with at least one of said fastening members, at least one of said fastening members comprising a stud attached to one of said skis having an end portion adapted to cooperatively engage said hole in said end of said fastening member, said end portion of said stud being larger in diameter than the diameter of the corresponding hole in said connecting member, with said connecting member cooperatively engaging said fastening member by elastic deformation of said connecting member about said end portion of said stud, a sleeve member positioned in encompassing relationship to a portion of said stud forming a surrounded portion, spring bias means which urges said sleeve member toward said ski, and lever means having a first end portion positioned between a bottom portion of said sleeve and said ski and a second end portion spaced from said first end portion, said lever means adapted to displace said sleeve upwardly toward the end of said stud to assist in the removal of said connecting member from cooperative engagement with said end of said stud by displacement of said first end portion of said lever means upwardly upon displacement of said second end of said lever means.

2. The ski accessory of claim 1 wherein said connecting member is comprised of two portions which slidably engage each other to permit the distance between said ski tips to be varied.

3. The ski accessory of claim 1 wherein said lever means includes an elastic portion which is attached to said ski beneath said sleeve, said lever means further including inflexible portions adjacent said elastic portion which displace said sleeve upwardly upon downward movement of said lever means.

4. The ski accessory of claim 1 wherein said stud includes a portion of lesser diameter than said end portion of said stud between said end portion and said surrounded portion about which said connecting member may rotate upon engagement with said fastening member.

5. An accessory for skis adapted to link the tips of said skis together to facilitate the guidance of same, comprising:

two fastening members adapted to be attached to the respective tip ends of a pair of skis; and a connecting member having opposing ends, said ends being adapted to be pivotably attached to said respective fastening members on said respective tip ends of said pair of skis, said connecting member being planar in configuration and resiliently deformable by either twisting or bending and permitting the orientation of one of said skis to be changed relative to the orientation of the other of said skis as a result of said twisting or bending while maintaining said tips spaced from each other, said connecting member including a first hole in at least one end adapted for pivotable engagement with at least one of said fastening members, at least one of said fastening members comprising a portion adapted to be rigidly attached to said ski which includes a slot configured to engage an end portion of said connecting member by insertion of same into said slot, said fastening member further including a second hole in a portion thereof for alignment with said first hole and pin retaining means to cooperatively engage said aligned first and second holes upon insertion of said connecting member into said slot to retain said connecting member in said slot, said fastening member further including means to urge said pin retaining means into cooperative engagement with said aligned first and second holes comprising a resilient member to which said pin retaining means is attached.

6. An accessory for skis adapted to link the tips of a pair of skis together to facilitate their guidance, comprising a connecting member and two securement elements adapted to be rigidly secured to the tips of the skis, the securement elements each comprising a lug having a head and a neck of lesser diameter than said head, said head being adapted to be engaged in a recess of the connecting member, wherein the connecting member comprises a semi-rigid resilient bar having adjacent each of its ends a hole comprising said recess, said hole having at least one radial dimension smaller than a transverse dimension of the head of the securement elements and being elongated in the longitudinal axis of the bar, at least one of said hole and said head being elastically deformable to permit engaging the bar on each lug by exerting sufficient pressure on said lug, separation being effected by pulling the bar off of the lug.

7. Accessory according to claim 6, wherein said neck is so dimensioned relative to said head as to create a self-locking effect when the bar is inclined and displaced from a plane perpendicular to the axis of the lug.

8. Accessory according to claim 6, characterized in that the bar has several holes longitudinally aligned adjacent at least one of its ends so as to enable changing the distance separating the tips of the skis.

* * * * *